US011988408B2

(12) United States Patent
Wang et al.

(10) Patent No.: US 11,988,408 B2
(45) Date of Patent: May 21, 2024

(54) HUMIDIFIER

(71) Applicants: Chi Hsiang Wang, Burnaby (CA); Hao Han Wang, Burnaby (CA)

(72) Inventors: Chi Hsiang Wang, Burnaby (CA); Hao Han Wang, Burnaby (CA)

( * ) Notice: Subject to any disclaimer, the term of this patent is extended or adjusted under 35 U.S.C. 154(b) by 318 days.

(21) Appl. No.: 17/706,667

(22) Filed: Mar. 29, 2022

(65) Prior Publication Data

US 2023/0012780 A1 Jan. 19, 2023

Related U.S. Application Data

(60) Provisional application No. 63/223,128, filed on Jul. 19, 2021.

(51) Int. Cl.

| | |
|---|---|
| ***F24F 6/10*** | (2006.01) |
| ***F24F 6/02*** | (2006.01) |
| ***F24F 11/00*** | (2018.01) |
| ***F24F 11/30*** | (2018.01) |
| ***F24F 11/89*** | (2018.01) |
| *F24F 6/00* | (2006.01) |

(52) U.S. Cl.

CPC ..... *F24F 6/10* (2013.01); *F24F 6/025* (2013.01); *F24F 11/0008* (2013.01); *F24F 11/30* (2018.01); *F24F 11/89* (2018.01); *F24F 2006/008* (2013.01)

(58) Field of Classification Search

CPC ..... F24F 6/025; F24F 6/10; F24F 11/0008; F24F 11/30; F24F 11/89; F24F 2006/008

USPC ..... 261/142, 72.1, DIG. 65

See application file for complete search history.

(56) References Cited

U.S. PATENT DOCUMENTS

| | | | | |
|---|---|---|---|---|
| 6,591,061 | B2 * | 7/2003 | Wang | F24F 6/10 392/395 |
| 2010/0258958 | A1 * | 10/2010 | Wong | F24F 6/04 261/38 |
| 2024/0068679 | A1 * | 2/2024 | Johnson | F24F 11/0008 |

* cited by examiner

*Primary Examiner* — Charles S Bushey
(74) *Attorney, Agent, or Firm* — Frank Marino

(57) ABSTRACT

A humidifier has a base and a housing. The housing has a steam exhaust vent and a vaporizer. The vaporizer includes a heating element surrounded by a removable porous sleeve that protrudes downwardly into water within a reservoir of the base. The sleeve wicks the water including its minerals and impurities into contact with the heating element wherein energization of the heating element causes the wicked water to convert to steam that rises through the exhaust vent and from the housing during a humidification mode.

21 Claims, 18 Drawing Sheets

HUMIDIFIER

FIELD OF THE INVENTION

This invention relates to household humidifiers, and more specifically, to safety, convenience, and health improvements thereto.

BACKGROUND OF THE INVENTION

Household humidifiers have existed for many decades. Such appliances generally fall into one of the following five categories; Vaporizers, Warm Mist, Cool Mist, Evaporative, and Ultrasonic.

Vaporizers include a pair of electrodes of different voltage levels submersed in water to cause a vaporizing electrical current therebetween within the water which boils to release humidity into the room.

Vaporizers include a pair of electrodes of different voltage levels submersed in water to cause a vaporizing electrical current therebetween within the water which boils to release humidity into the room.

Warm Mist humidifiers include a heating element submersed in water to boil the water and cause it to vaporize and be released as humidity into the room.

Cool Mist humidifiers include an impellor submersed in water to cause the water into a mist and a blower to force the mist as humidity into the room.

Evaporative humidifiers include either a porous wick to draw water upwards from a reservoir or a pump to force water to flow over and down through a porous medium, and a fan to plow air through the porous wick or medium to moisten it and force the moistened air as humidity into the room.

Ultrasonic humidifiers include a high frequency agitator submersed in water to turn the water into a very fine mist and a blower to force the very fine mist as humidity into the room.

Each type of prior art humidifier suffers from one or more real or perceived drawbacks;

Vaporizers provide a pure and healthful humidity but are noisy and prone to safety hazards. Because the current drawn is proportional to the hardness of the water, it is impossible to accurately control the current and the boiling rate. This often leads to spitting if very hot water which poses both a safety risk and damage to surrounding furnishings. And because the water itself is a live part of the electrical circuit, a shock hazard can exist. Minerals in the water collect on and permanently impede the efficiency of the electrodes over time.

Warm Mist humidifiers provide a pure and healthful humidity but are noisy and prone to reliability problems. Minerals in the water collect on and impede the efficiency of the heating elements and create a difficult cleaning burden.

Cool Mist humidifiers are noisy and spray mist which includes all of the minerals and impurities in the water. These can be unhealthful to breathe and can coat surrounding furnishings and be difficult to remove.

While Evaporative humidifiers generally provide a pure and healthful humidity if diligently maintained, their wicks draw germs from the water which thrive and quickly multiply within the damp and porous wick. This can cause odors and the germs can promote mold which then releases its unhealthy spores into the air. The wicks are necessarily expensive which inspires users to change them less often than is needed to maintain a healthful output.

Ultrasonic humidifiers are accused of causing of Legionnaires' Disease by agitating germs in the water at ultrasonic frequencies and causing the genes of the germs to be broken into unnatural sub-strands that are released into the room and inhaled. It is believed that our immune systems have not evolved to fight such unnatural strands.

There exists the need and it is an object of the invention to provide a humidifier that solves the drawbacks of prior art humidifiers.

There exists the need and it is a further object of the invention to provide such a humidifier that provides healthful humidity.

There exists the need and it is a further object of the invention to provide such a humidifier that is safe, quiet, and odorless.

There exists the need and it is a further object of the invention to provide such a humidifier that maintains itself in a safe and healthful condition automatically.

Additional needs and objects will become apparent from a reading of the following information.

SUMMARY OF THE INVENTION

The present invention is a humidifier of a novel category which includes both a wick and a wick heater and is arranged to cause vaporization without boiling and to cause humidification having the healthful qualities of a diligently-maintained evaporative humidifier without the need for the diligent maintenance. The humidifier may be further adapted to automatically sterilize its wick and/or other internal components on a regular basis to prevent the growth of germs therein. The arrangement reduces noise and extends the lifetime of the wick while preventing the release of odors and unhealthy mold spores into the air.

The invention may be embodied in or practiced using a humidifier having a housing and a base, wherein the housing includes a top side with a steam exhaust vent and a fill opening there-through, a tank adapted to receive water through the fill opening, and a one-way fill valve to allow the water downwardly through the fill opening but otherwise close the fill opening, and having a vaporizer including a heating element surrounded by a removable porous sleeve, the sleeve protruding downwardly from the housing and in fluid communication with the steam exhaust vent, and the base is adapted to removably receive the housing there-atop and includes a reservoir for receiving water from the tank and for receiving the porous sleeve, whereby the porous sleeve wicks water from the reservoir including minerals and impurities therein into contact with the heating element, wherein energization of the heating element causes the wicked water to convert to steam which rises through the steam exhaust vent and from the housing during a humidification mode, and wherein the minerals and impurities remain within the porous sleeve.

The steam exhaust vent further may include a normally open exhaust valve which is closed during a sterilization mode to prevent the steam from rising through the steam exhaust vent, whereby the steam circulates within the humidifier to sterilize surfaces and components therein.

The humidifier may have a water level sensor in electrical communication with the heating element and the exhaust valve and adapted to sense a water level within the reservoir to enable energization/de-energization of the heating element and opening/closing of the exhaust valve according thereto.

The tank may include a normally closed water-release valve that prevents the outflow of water from the tank when the tank is not properly received by the base, and the base may include a valve actuator adapted to open the water release valve and allow water from the tank into the reservoir there-through until a water level in the reservoir rises to a first water level. The water level sensor may enable energization of the heating element when the water level in the reservoir rises to the first water level to thereby enable the humidification mode.

The water level sensor may be adapted to sense when the water level in the reservoir falls to a second water level lower than the first water level and to then close the exhaust valve to thereby enable the sterilization mode. The water level in the reservoir may fall to the second water level when the tank has become empty of water.

The water level sensor may be adapted to sense when the water level in the reservoir falls to a third water level lower than the second water level and to then de-energize the heating element.

The water level sensor may be adapted to enable re-opening of the exhaust valve when the water level in the reservoir falls to the third water level.

The valve actuator may be a float that rises and falls with the water level in the reservoir. The housing may include the water level sensor. The top side may be a cover removable from the housing and including the steam exhaust vent, the fill opening, the exhaust valve, and the one-way fill valve.

The humidifier may alternatively include a timer adapted to de-energize the heating element when a predetermined sterilization period has passed. The timer may be adapted to enable re-opening of the exhaust valve when the predetermined sterilization period has passed. The porous sleeve may be made of a heat-tolerant material and the predetermined sterilization period may be long enough to ensure that the porous material has wicked all water from the reservoir during the sterilization period.

Many aspects of the invention can be better understood with reference to the following detailed description of an exemplary humidifier along with accompanying drawings. The components in the drawings are not necessarily to scale, emphasis instead being placed upon clearly illustrating the principles of the invention.

DETAILED DESCRIPTION OF THE INVENTION

Figure 1:
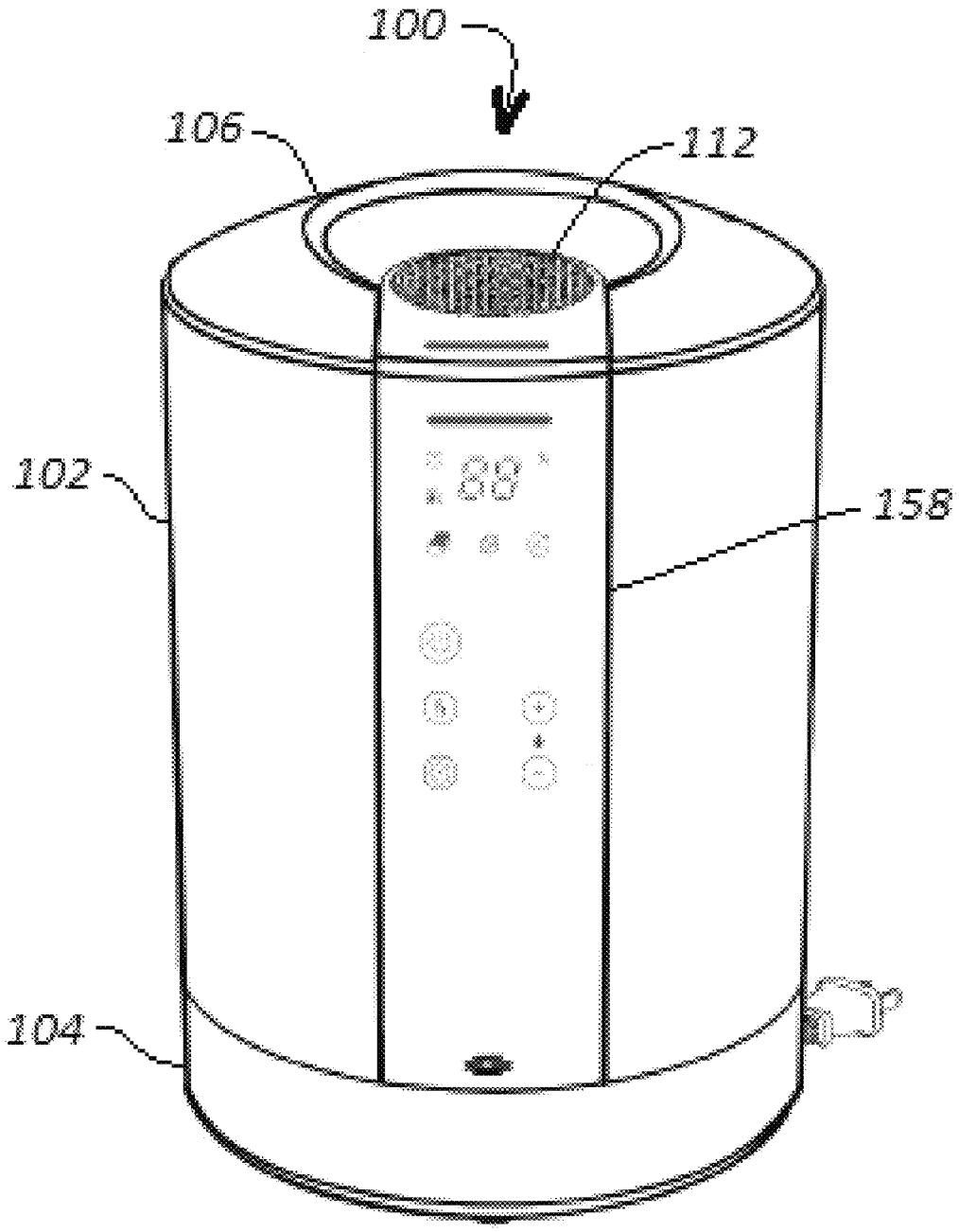
FIG. 1 is a perspective view of an exemplary humidifier according to or useful in practicing the invention.
Figure 2:
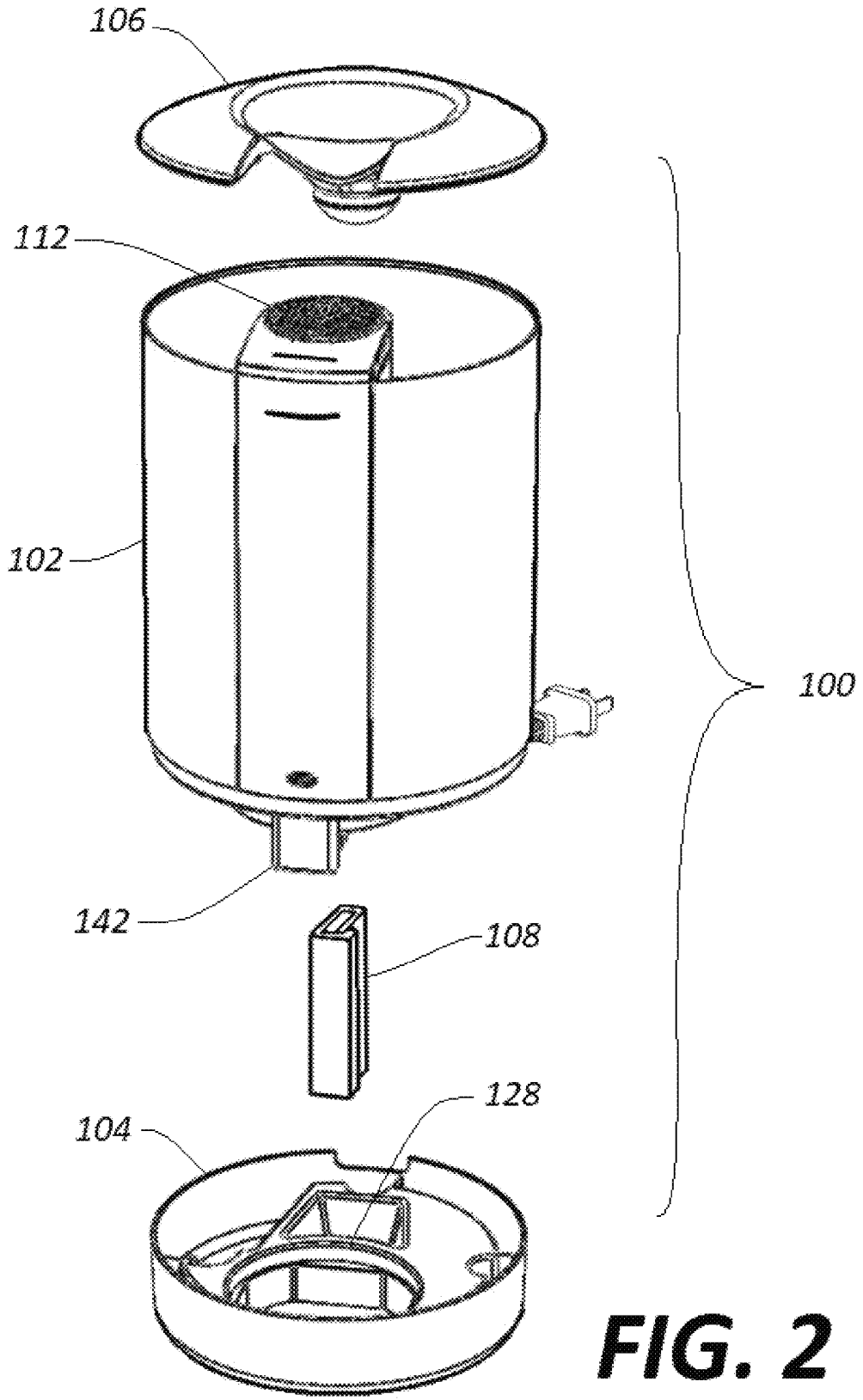
FIG. 2 is an exploded view of the major components of the humidifier of FIG. 1.
Figure 3:
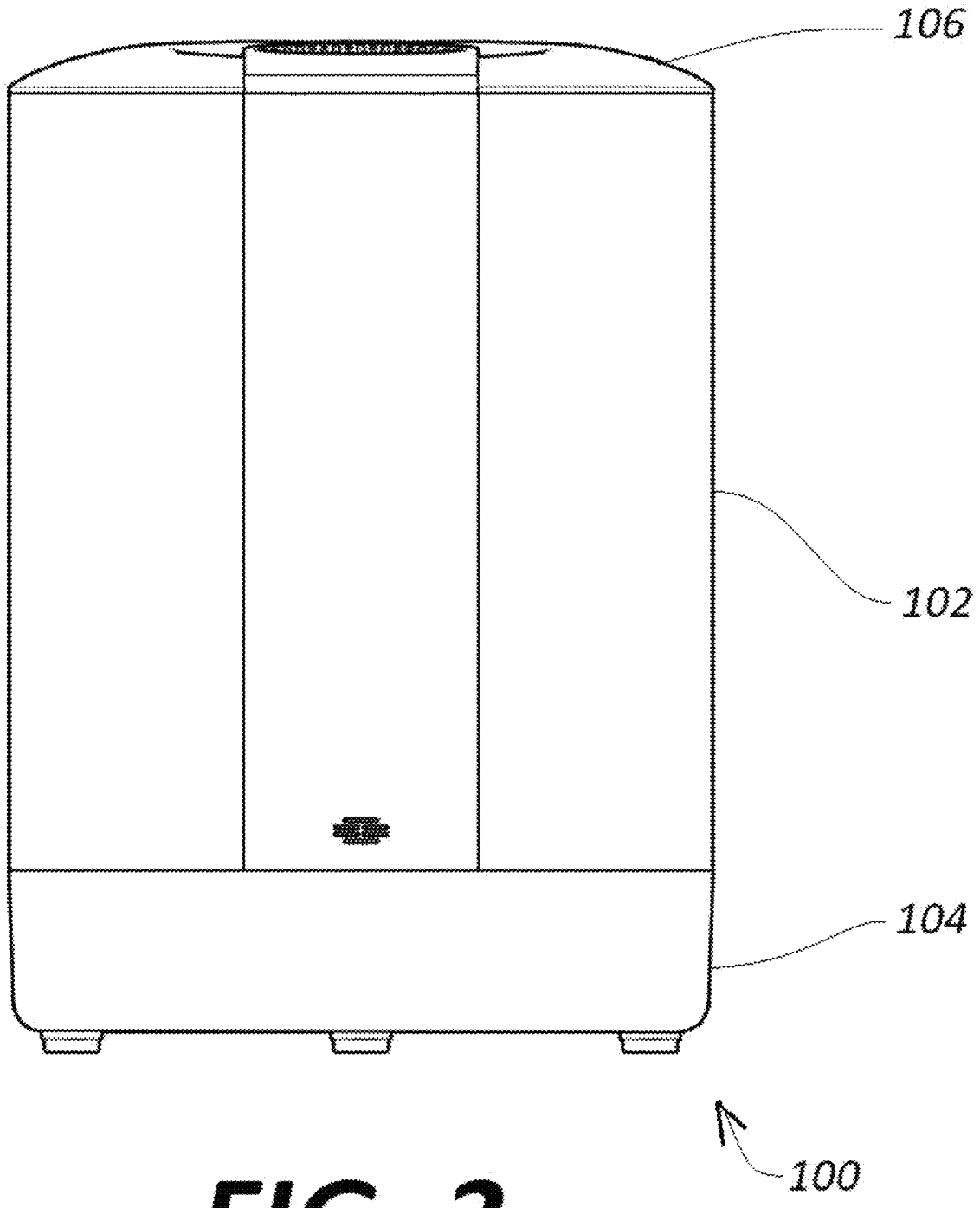
FIG. 3 is a front view of the humidifier of FIG. 1.
Figure 4:
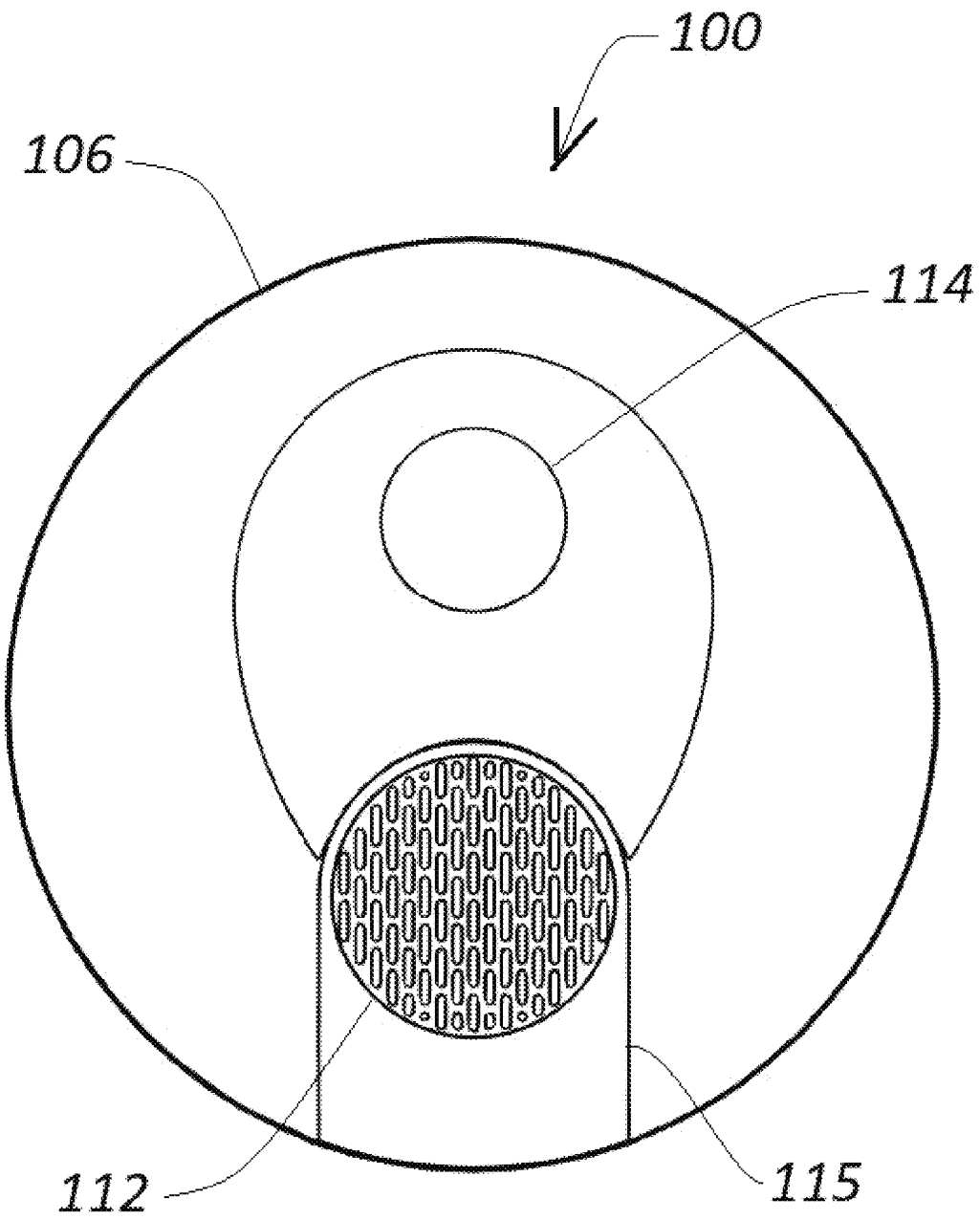
FIG. 4 is a top view of the humidifier of FIG. 1.
Figure 5:
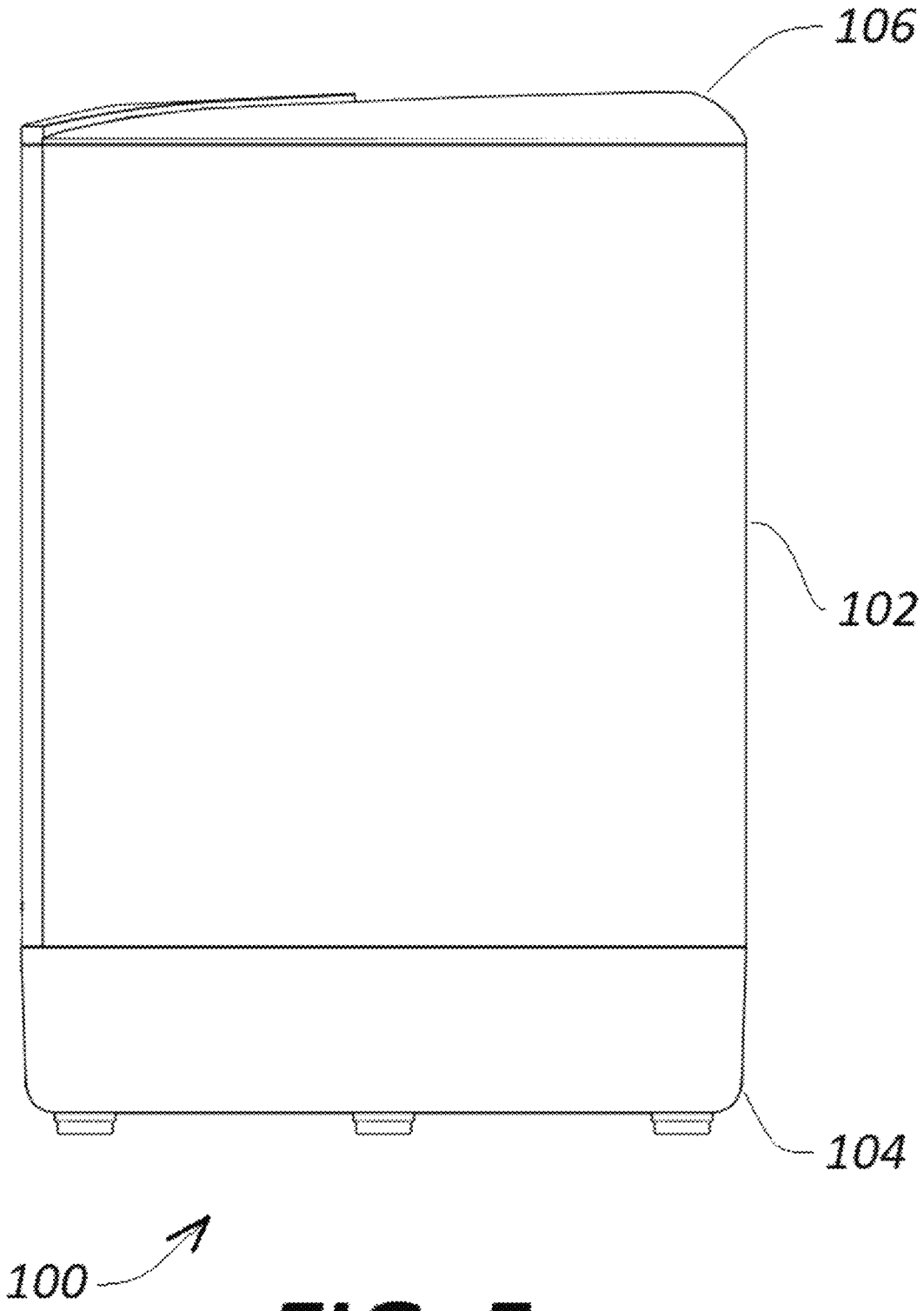
FIG. 5 is a side view of the humidifier of FIG. 1.
Figure 6:
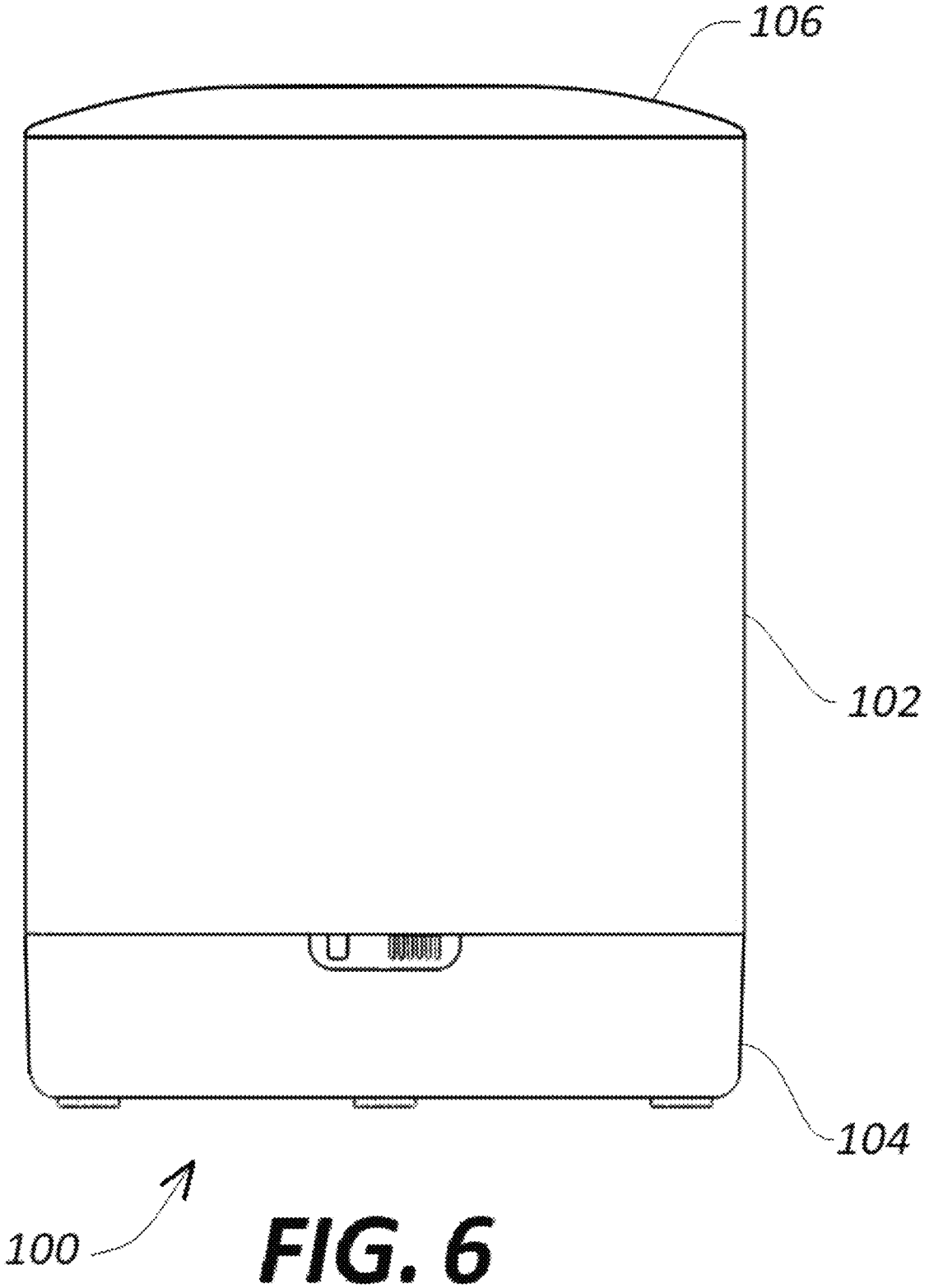
FIG. 6 is a rear view of the humidifier of FIG. 1.

Referring to FIGS. 1 through 13, there is shown an exemplary tabletop humidifier 100 which includes a hollow housing 102, a base 104, a cover 106, and a porous absorption sleeve 108, all seen best in FIG. 2

Referring to FIGS. 2, 4, and 7A through 8B, the cover forms a top side of the housing when mounted thereon and is removable therefrom for accessing the inside components thereof. The housing has a steam exhaust vent 112 avoided by the cover and the cover a fill opening 114 there-through. Grill 115 overlays the exhaust vent and prevents objects for falling therethrough while allowing ventilation.

Figure 7A:
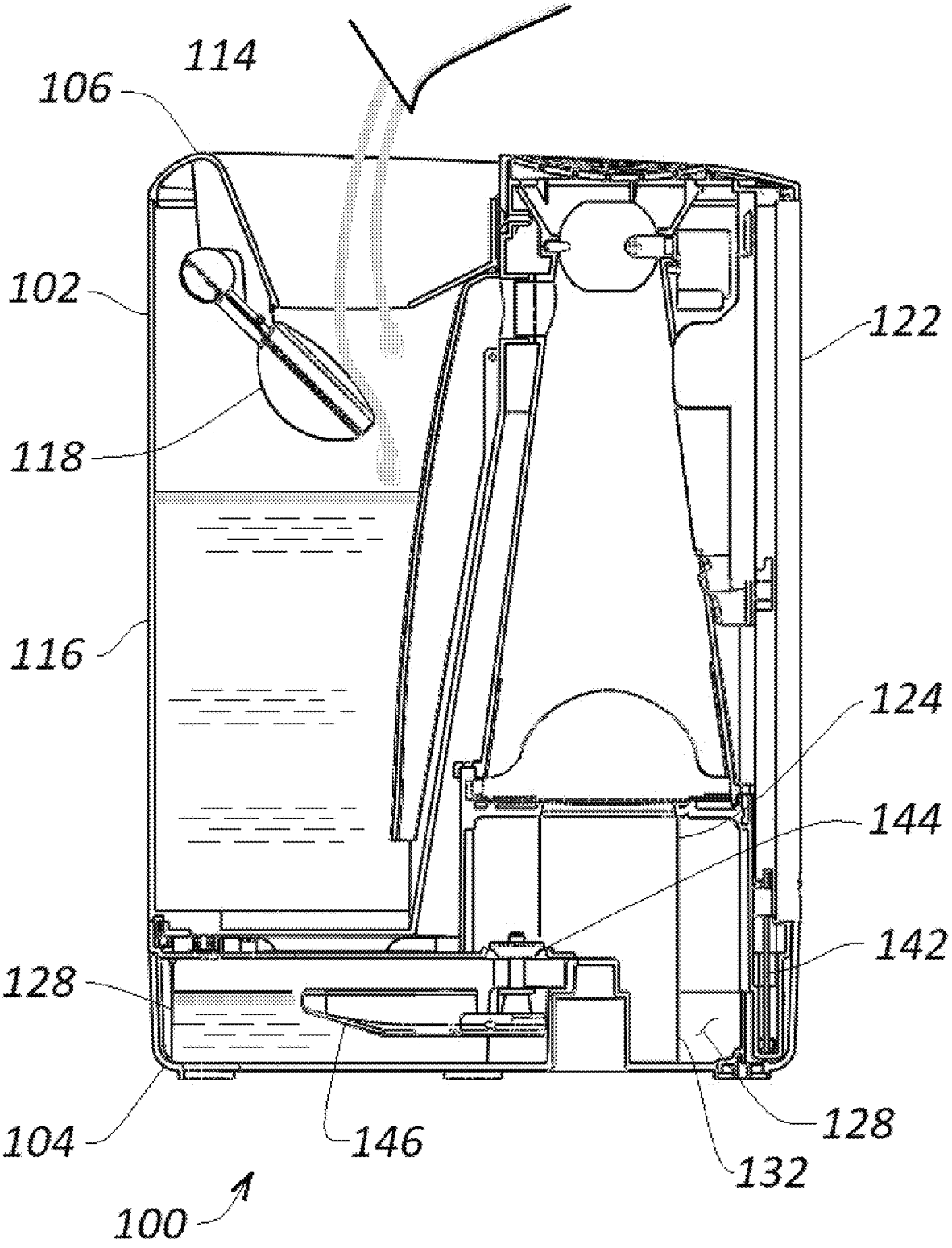
FIG. 7A is a cross-sectional view of the humidifier of FIG. 1 during filling.

The housing contains a water tank 116 which communicates with and is adapted to receive water through the fill opening as in FIG. 7A. The fill opening includes a normally closed one-way fill valve 118 which allows water downwardly through the fill opening but otherwise closes the fill opening. The fill valve hingedly affixed to and removable with the cover and is a torsion spring-biased and counter-balanced flapper valve seen best in FIGS. 7A, 7B, and 11 through 12B.

The housing includes a controller 122. Vaporizer 124 includes a PTC heating element 126 electrically controlled by the controller and depending downwardly from the housing and surrounded by the removable porous absorption sleeve. The sleeve is made of a heat-resistant non-flammable wicking material, preferably polyester felt because it has good wicking qualities, is tolerant to the high temperatures needed for steam generation, is germ-resistant, is dish-washer-safe, and is acid resistant. The sleeve may be a cylindrical tube or sock that slides up and tightly around the heating element of may be a sheet which wraps tightly around the heating element and is secured by such means as hook-loop fastening. The sleeve is thereby easily removable from the heating element for changing and cleaning, and hangs from the housing below the heating element. The sleeve and heating element are below and in fluid communication with the steam exhaust vent though vertical chimney 127.

Figure 7B:
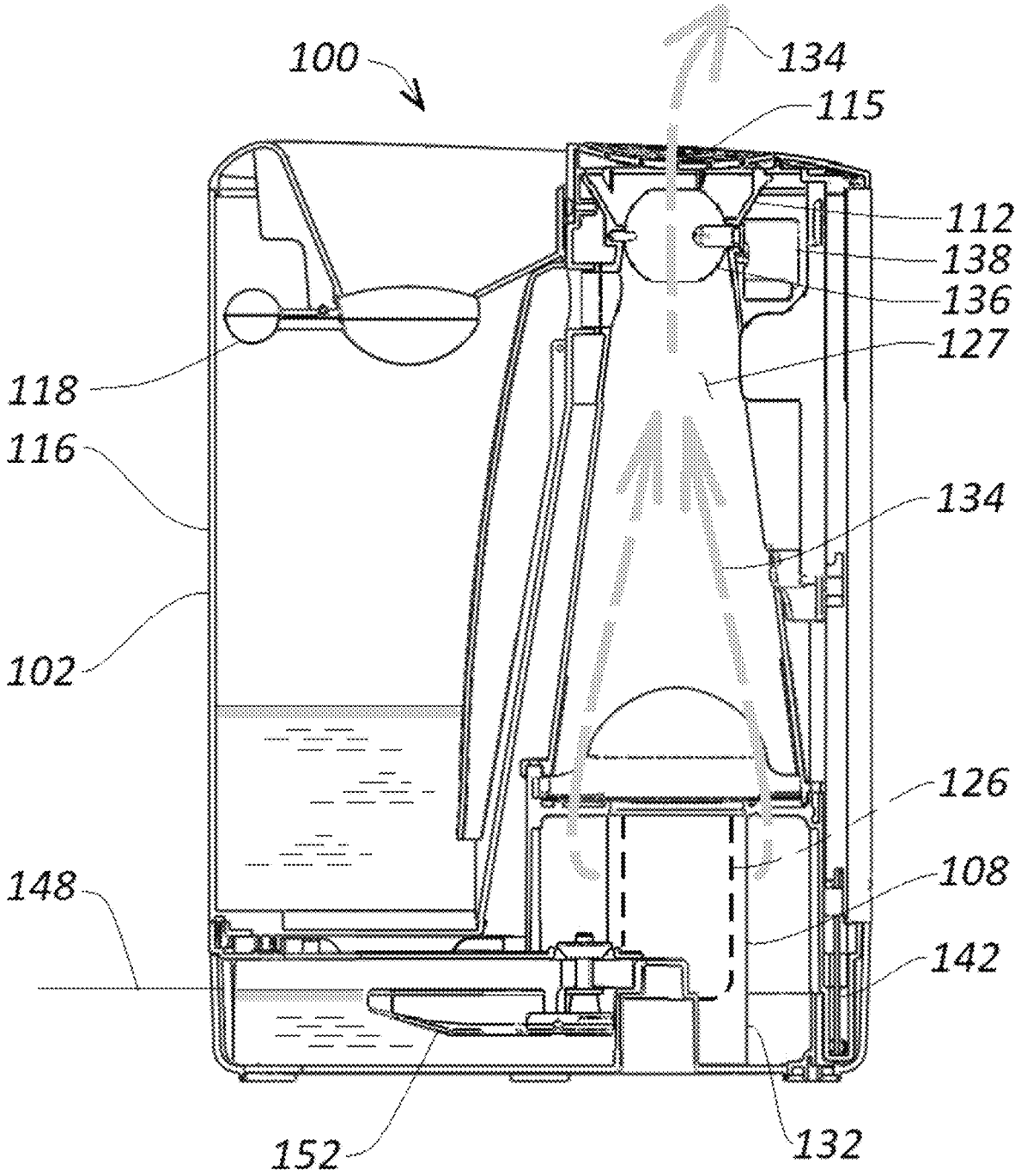
FIG. 7B is a cross-sectional view of the humidifier of FIG. 1 during humidifying.
Figure 7C:
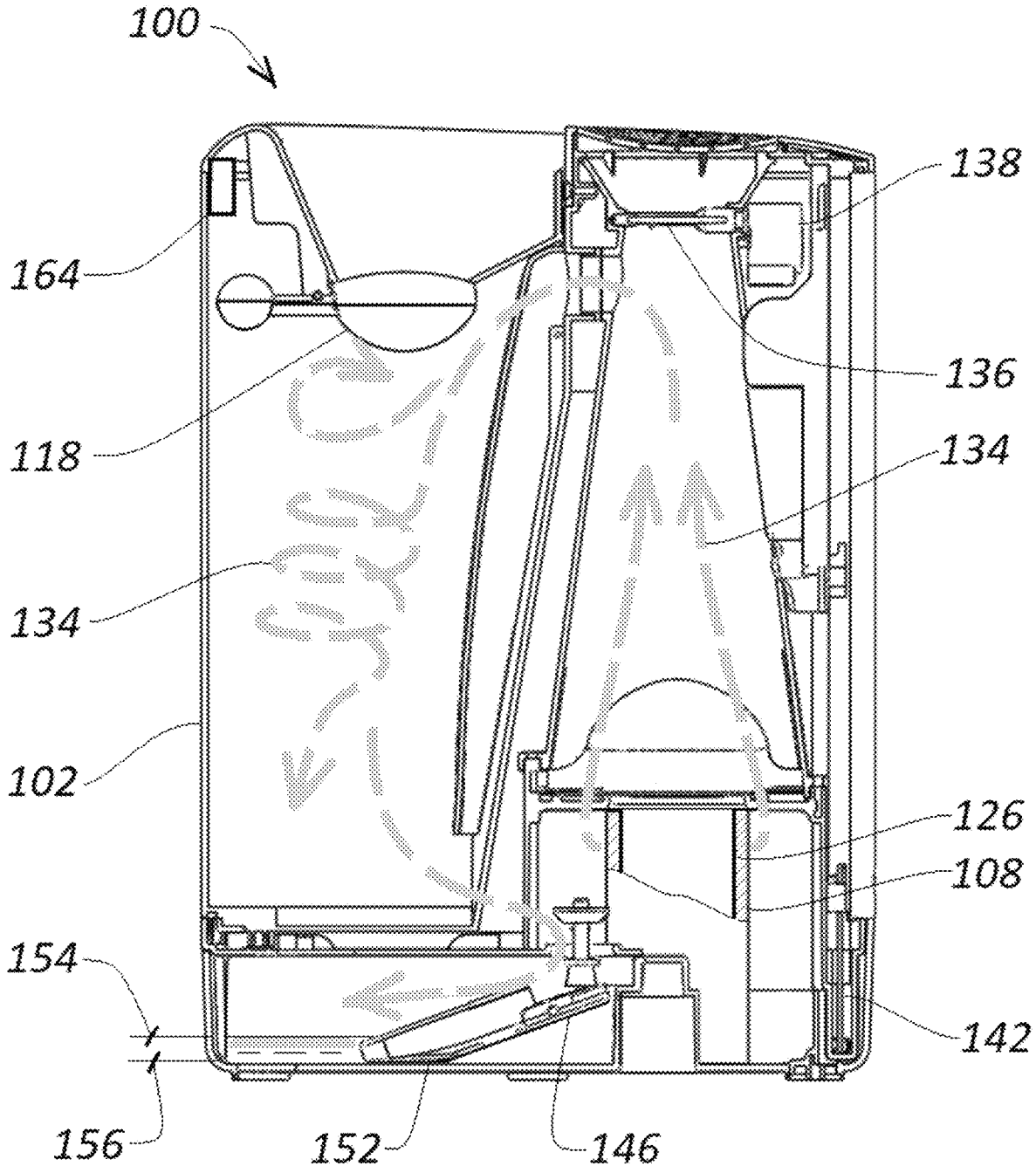
FIG. 7C is a cross-sectional view of the humidifier of FIG. 1 during sterilizing.
Figure 8A:
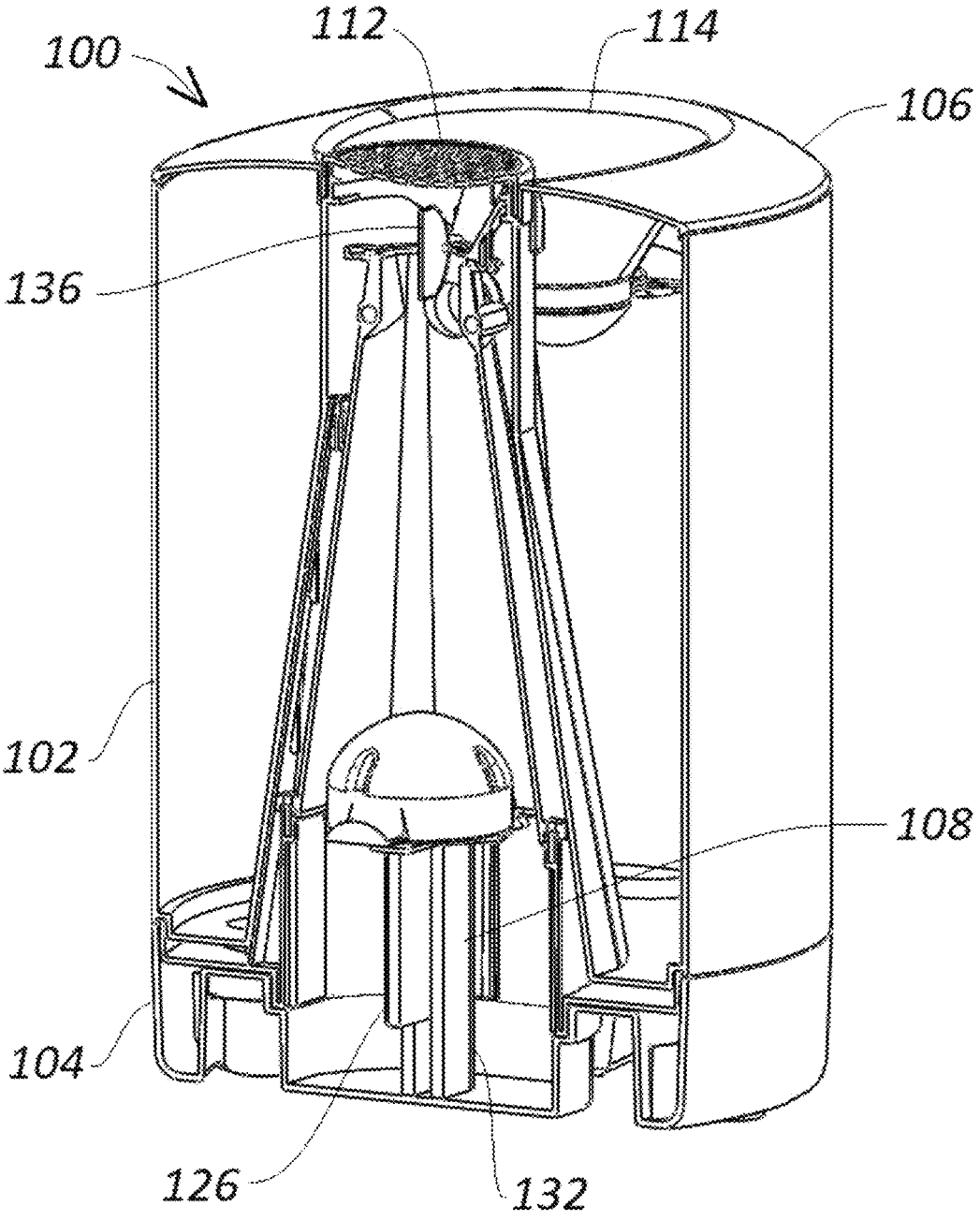
FIG. 8A is a cross-sectional perspective view of the humidifier of FIG. 1.
Figure 8B:
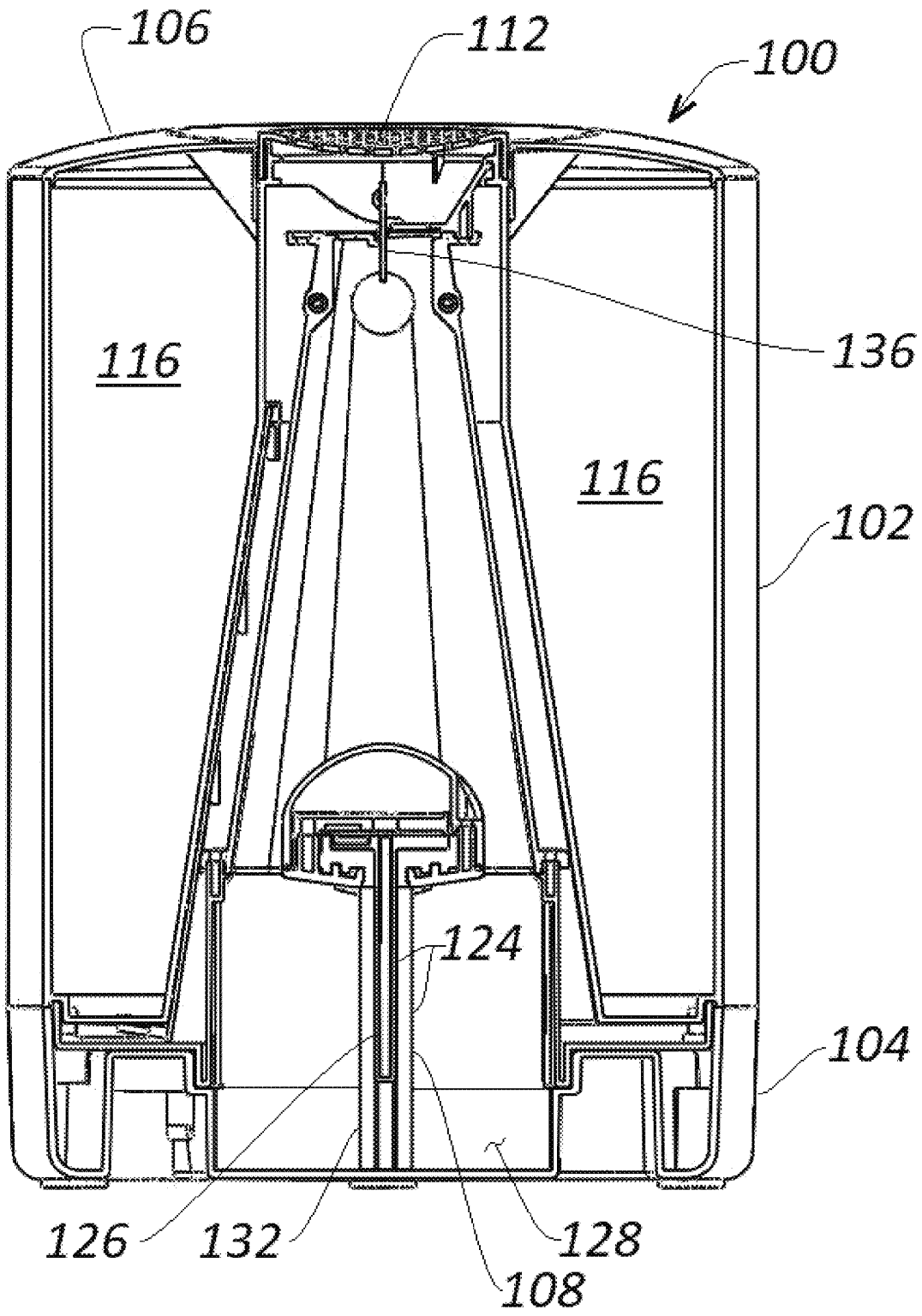
FIG. 8B is a cross-sectional view of the humidifier of FIG. 1.
Figure 9A:
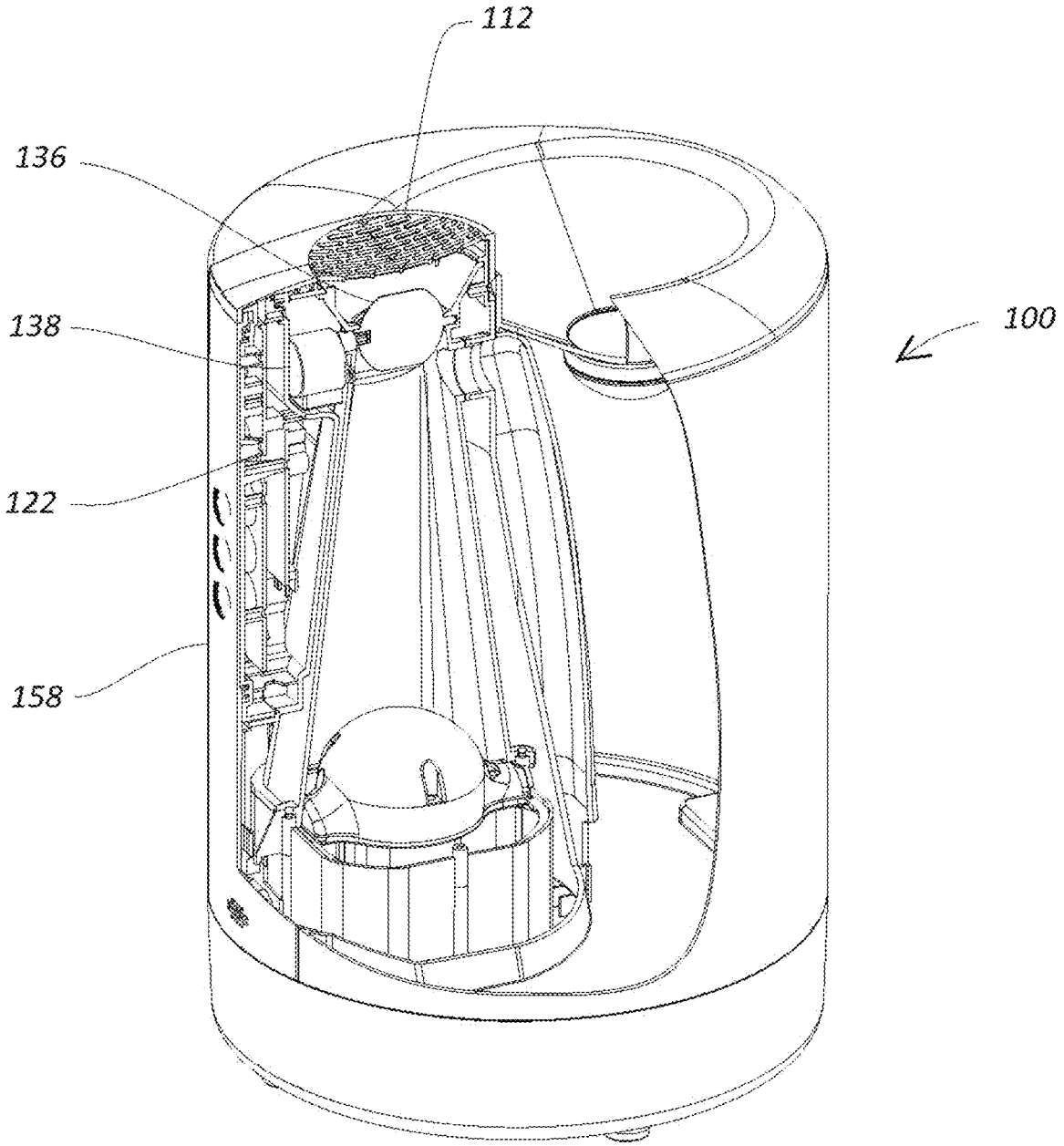
FIG. 9A is a break-away view of the humidifier of FIG. 1 during the humidification mode.
Figure 9B:
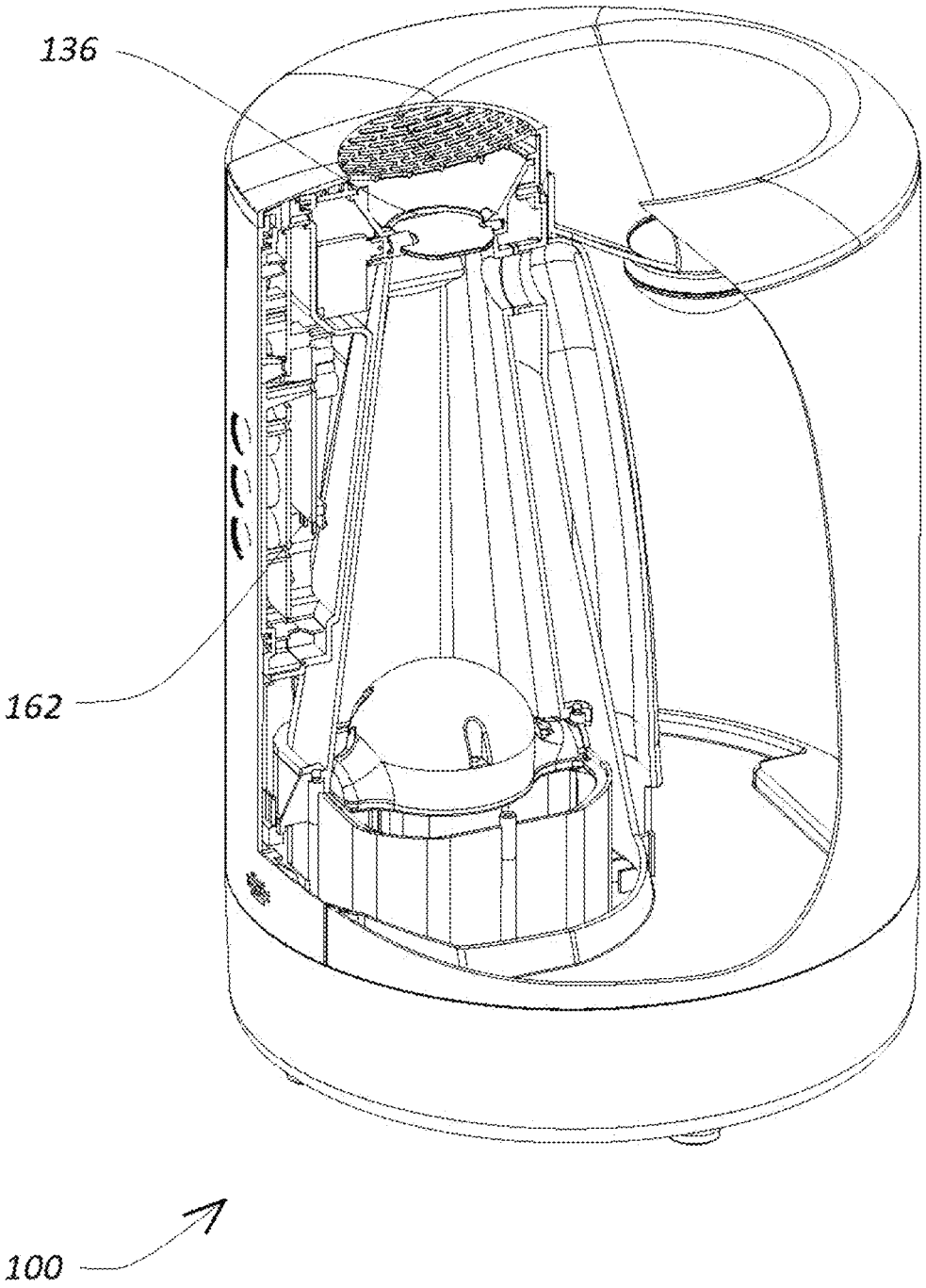
FIG. 9B is a break-away view of the humidifier of FIG. 1 during the sterilization mode.
Figure 10:
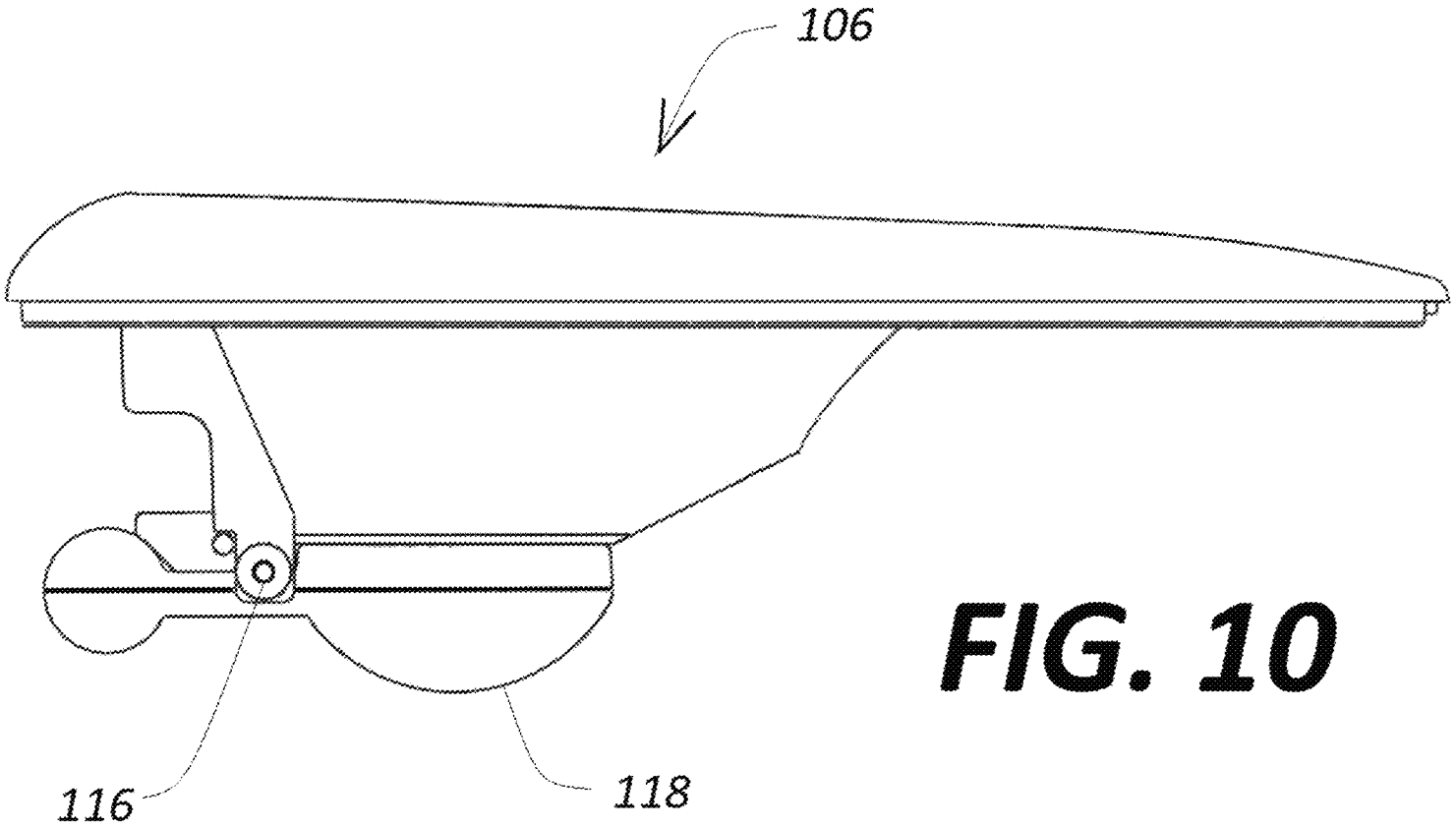
FIG. 10 is a partial cross-sectional view of the cover of the humidifier of FIG. 1 during non-filling and during use.

The base is adapted to removably receive the housing there-atop and includes a reservoir 128 for receiving water from the water tank and for receiving the lower end 132 of the porous sleeve, whereby when water is within the reservoir and submerges at least a portion of the lower end, the porous sleeve wicks the water up, around, and in contact with the heating element, including minerals and impurities that may reside within that water. Energization of the heating element then causes the wicked water to convert to clean pure steam 134 which rises through the steam exhaust vent and from the housing during a humidification mode, and the minerals and impurities remain within the porous sleeve. This is depicted in FIG. 7B.

The steam exhaust vent includes a normally open exhaust valve 136 including and controlled by a stepping motor 138. The exhaust valve is an unbiased butterfly valve having only two functional positions as controlled by the stepping motor; the open position of FIG. 7B and the closed position of FIG. 7C. It is open during the humidification mode as seen best in FIG. 7B to allow rising humidity to pass thereby, and it is closed during a sterilization mode to prevent the steam from rising through the steam exhaust vent and cause it to circulate within the humidifier to sterilize the surfaces and components therein, as seen best in FIG. 7C.

The housing includes a water level sensor 142 in electrical communication with the heating element and the exhaust valve's stepping motor. The sensor is adapted to sense the water level within the reservoir to enable energization/de-energization of the heating element and opening/closing of the exhaust valve according thereto.

The tank has a normally closed water-release valve 144 that prevents the outflow of water from the tank when the tank is not properly received by the base. The water-release valve is a compression spring-biased stem valve. The base includes a valve actuator 146 adapted to open the water release valve and allow water from the tank into the reservoir there-through until the water level in the reservoir rises to a first water level 148, being the normal operating level during the humidification mode. The valve actuator includes a float 152 that is hingedly connected to the base so that it is free to rise and fall with the water level in the reservoir.

The water level sensor then enables energization of the heating element when the water level in the reservoir rises to the first water level to thereby enable the humidification mode.

The water level sensor is disposed and adapted to sense when the water level in the reservoir falls to a second water level 154 lower than the first water level and to then close the exhaust valve to thereby enable the sterilization mode. The water level in the reservoir falls to the second water level only after the tank has become empty of water.

The water level sensor is also disposed and adapted to sense when the water level in the reservoir falls to a third water level 156 lower than the second water level, where the reservoir is at or near to completely empty, and to then de-energize the heating element and terminate the sterilization mode. The water level sensor enables re-opening of the exhaust valve when the water level in the reservoir falls to the third water level.

The controller includes circuitry connected to a user interface control panel 158 and circuitry with switches, indicators, a power controller, a timer 162, and a humidity sensor to enable control of various operations, such as ambient humidity level and rate of humidity output. The indicators may include a display to indicate settings and ambient room temperature sensed by the humidity sensor. The controller is adapted to vary the heater wattage according to operational requirements or user selection. The timer allows the user to select a time period for humidification in the event that less than a full tank of humidity is needed or desired, such as when the humidifier is used in a small room or only needed until the user has fallen asleep.

Rather than rely on the water level sensor sensing the third water level to terminate the sterilization mode, the timer may alternatively disable the heater to terminate the sterilization mode after a predetermined period of time, a sterilization period, at the end of which the reservoir is expected to be at or near completely empty. The timer would then also be adapted to enable re-opening of the exhaust valve when the predetermined sterilization period has passed.

As an added safety feature, an electrical cover lock 164 within the housing and circuitry secures the cover to the housing to ensure that the cover cannot be removed during the sterilization mode. The lock is unlocked once the sterilization mode is terminated.

The sanitizing mode may also be initiated manually by the user at any time by activating a switch on the control panel. The controller may require that the water level sensor confirms that the water level is below the first water level before enabling such activation.

Figure 11:
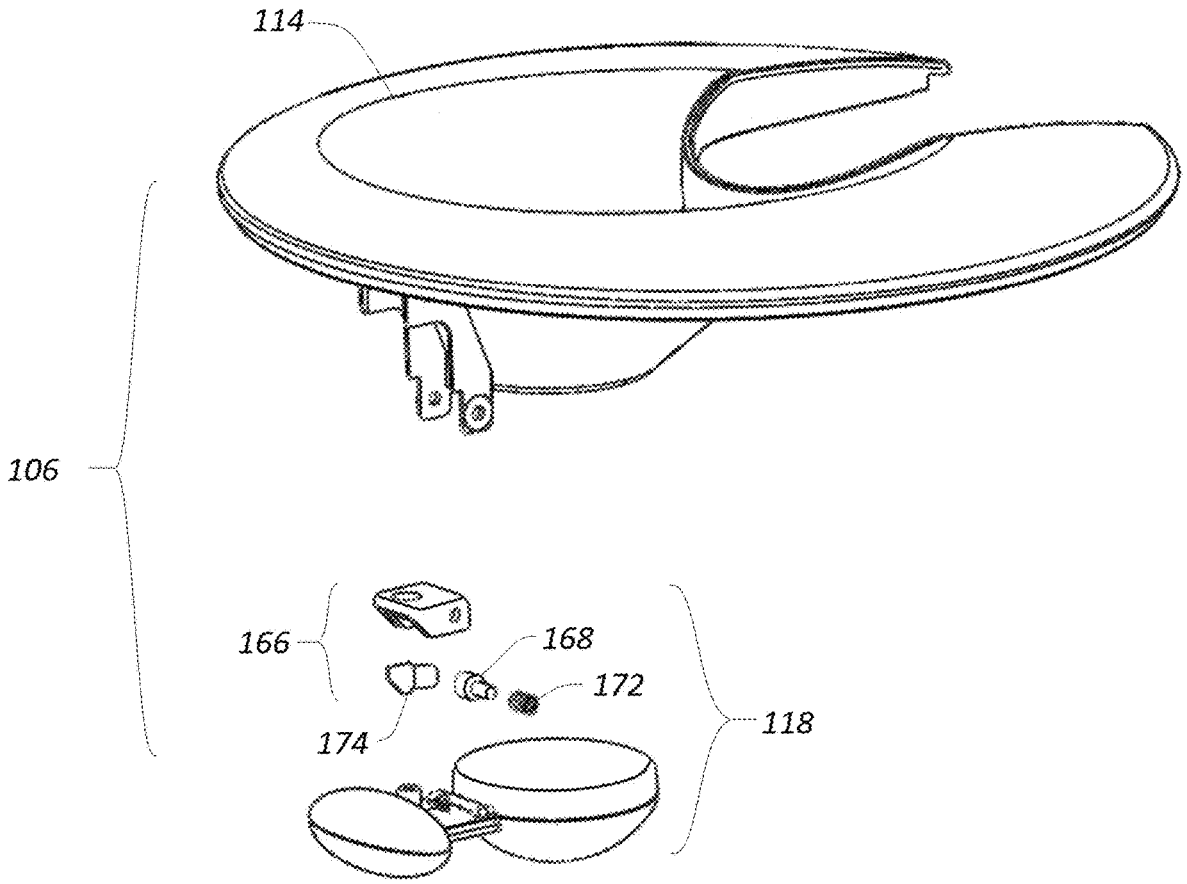
FIG. 11 is an exploded view of the cover assembly of the humidifier of FIG. 1.
Figure 12A:
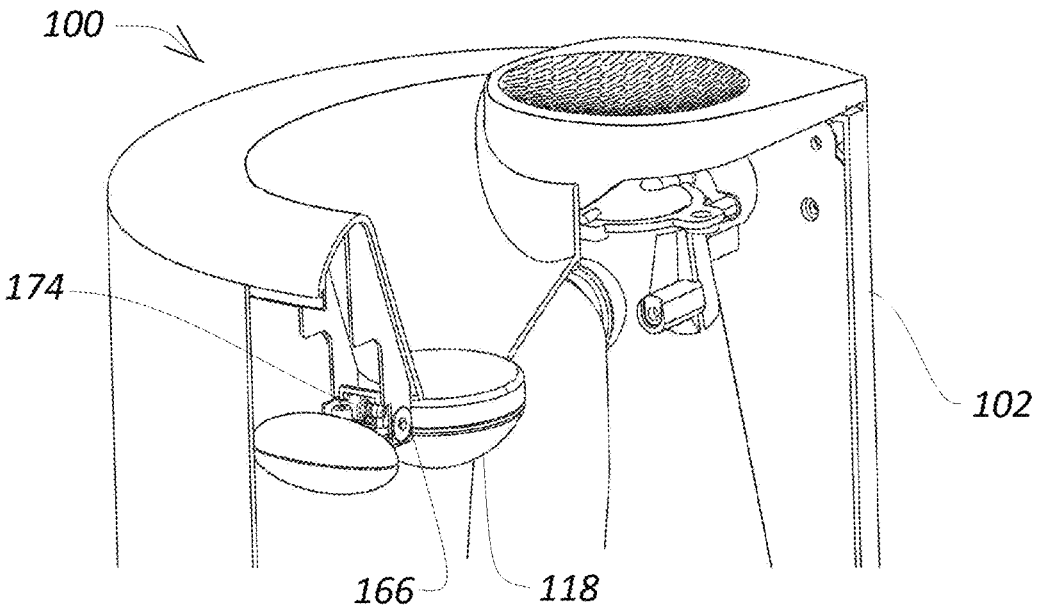
FIG. 12A is a close-up view of the fill valve of the humidifier of FIG. 1 in its unlocked state.
Figure 12B:
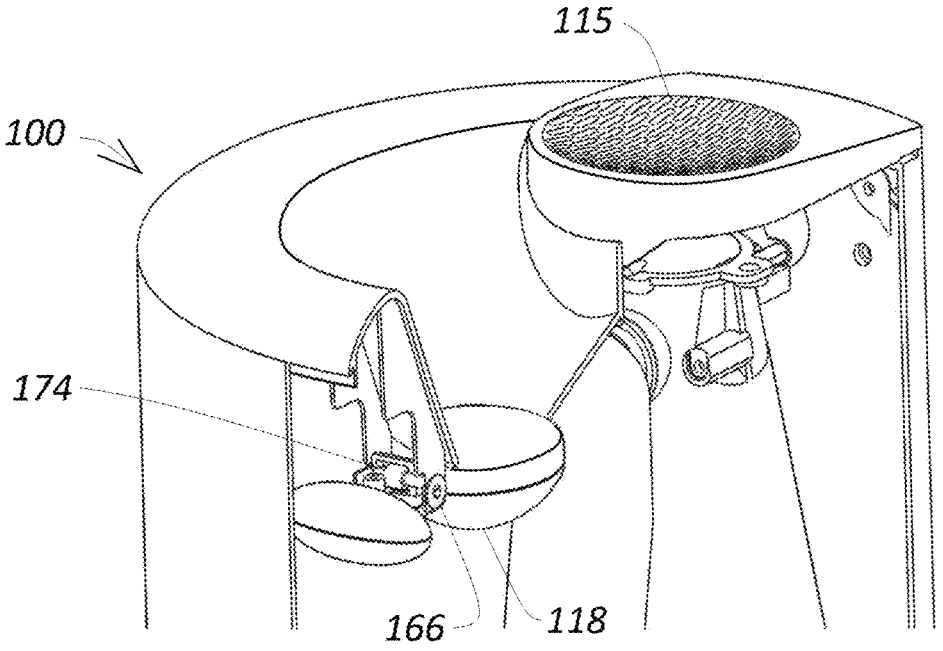
FIG. 12B is a close-up view of the fill valve of the humidifier of FIG. 1 in its locked state.
Figure 13:
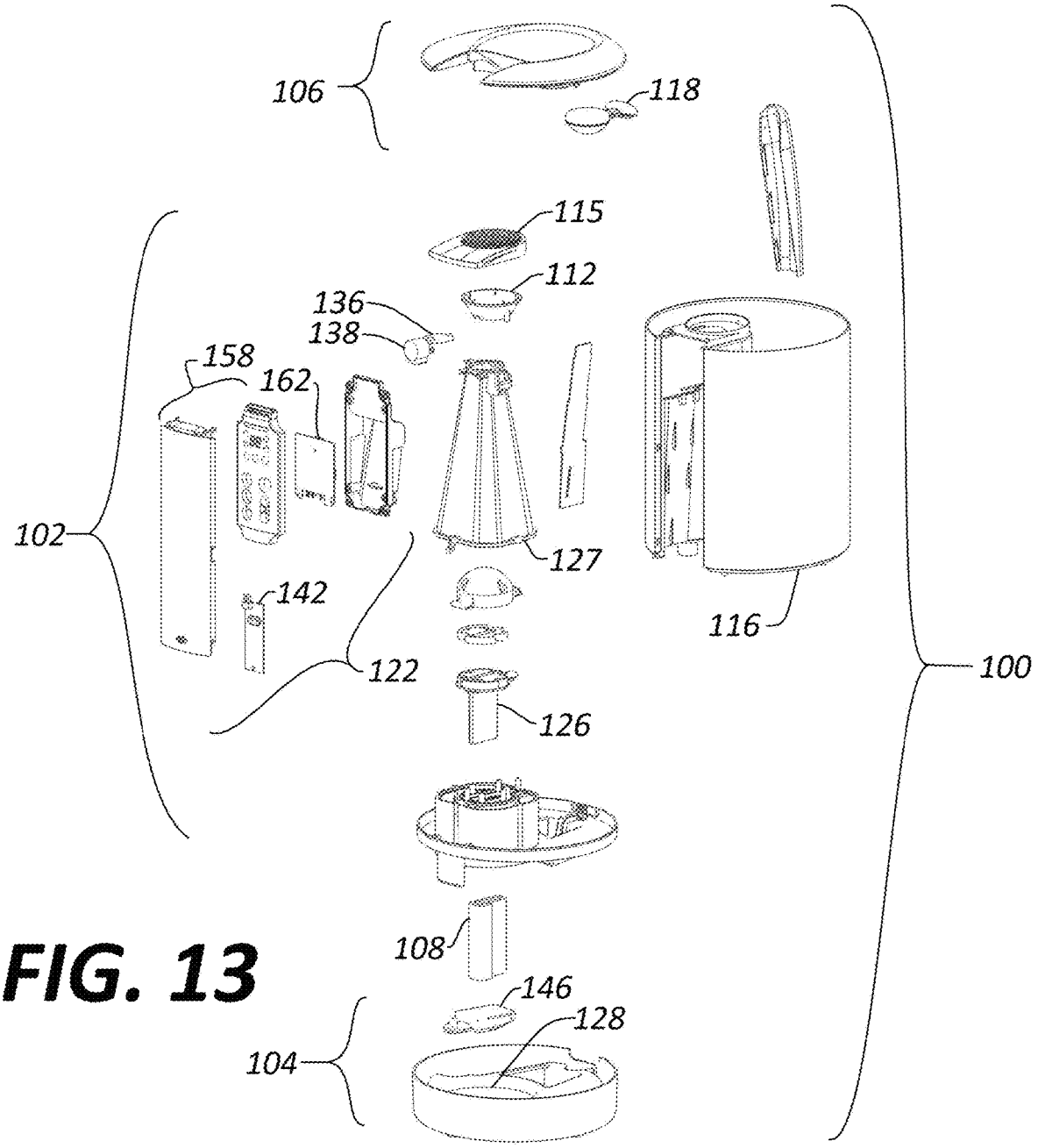
FIG. 13 is an exploded view of the humidifier of FIG. 1.

As a safety feature, the fill valve is adapted to lock in its closed position during the sterilization mode to avoid the burning of a hand or such by reaching inside the humidifier. This is accomplished by a heat-activated locking hinge 166 best seen in FIGS. 10 through 12B. While the valve is normally in its closed position as in FIGS. 10A and 12A, it is free to swing downwardly open about pin 168 against the bias of spring 172 by the weight and force of incoming water from above as shown in FIG. 11. The spring then biases the valve back upward to the closed state of FIGS. 10A and 12A to prevent airborne germs and dust from falling into the water tank. During sterilization mode, bimetal stopper 174 expands by exposure to the high temperature of the sterilizing steam and interferes with the hinge components as shown in FIG. 12B to prevent opening of the cap.

Figure 14A:
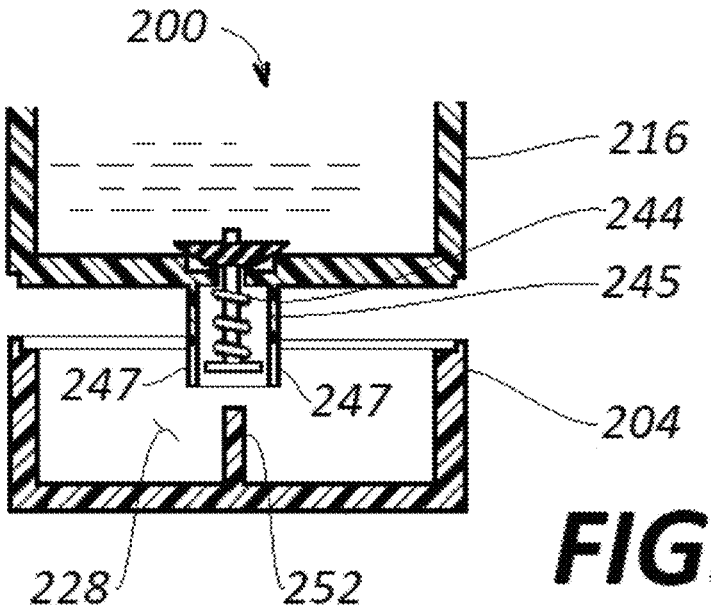
FIG. 14A is a partial cross-sectional view of an alternate water-release valve and valve actuator pair in its closed state.
Figure 14B:
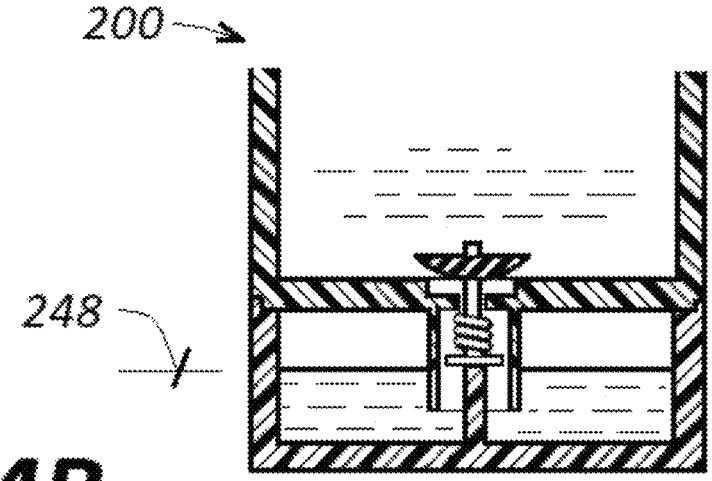
FIG. 14B is a partial cross-sectional view of the alternate water-release valve and valve actuator pair of FIG. 14A in its opened state.

FIGS. 14A and 14B depict an alternate humidifier embodiment 200 which is identical to the humidifier 100 except that rather than use a float as the valve actuator, a valve-actuating post 252 engages alternative water-release valve 244 when tank 216 is properly positioned on the base 204. The valve is surrounded by a cylindrical wall 245 that hangs into the base reservoir 228 and includes water level-establishing slots 247 adapted to prevent the water level in the reservoir from rising above the first water level 248 and to maintain that water level throughout the humidification mode.

Various aspects of the humidifier are worthy of special mention and repeat;

- Minerals and impurities are retained within the removable/replaceable wicking sleeve, which can be placed in a dishwasher, soaked in vinegar, otherwise cleaned, or simply replaced.
- While the pure output of a vaporizer or properly-maintained warm mist humidifier is achieved, there is no boiling and no heater submerged in the water where it would otherwise be plated by the water's minerals.
- The heating element does not need to be heated to a temperature high enough to cause boiling during humidification as in warm mist humidifiers and vaporizers . . . it needs only to get hot enough to cause evaporation of the moisture within the sleeve. This provides not only a safety and energy benefit, but also enables the humidity output rate to be varied simply by varying the heater wattage.
- The heater is operated at full wattage during the sterilization mode to ensure that the steam produced is hot enough to sterilize.

The base reservoir is emptied with every cycle to prevent the growth of germs in the water and the odors related thereto.

The sleeve is dried out with every cycle to prevent the growth of mold and the subsequent emission of mold spore.

The user never needs to sterilize the humidifier and its components by hand or by some arbitrary schedule . . . each operation cycle includes a sterilization routine that is adequate for proper and safe operation.

There is absolutely no noise during operation . . . no fan noise, no impeller noise, no boiling noise.

Neither the top cover nor the water tank needs to be removed for filling. The entire humidifier remains stationary in its desired location.

Because the water tank is opened-topped within the housing, it is treated by the steam as well during the sterilization mode.

For additional cleaning, if desired, the base, housing, and cover are easily separated to access internal surfaces

We claim:

1. A humidifier comprising:

a housing having;

a top side with a steam exhaust vent and a fill opening there-through, a tank adapted to receive water through the fill opening, and a one-way fill valve to allow the water downwardly through the fill opening but otherwise close the fill opening; and a vaporizer comprising a heating element surrounded by a removable porous sleeve, the sleeve protruding downwardly from the housing and in fluid communication with the steam exhaust vent;

a base adapted to removably receive the housing thereatop, and including a reservoir for receiving water from the tank and the porous sleeve; whereby, the porous sleeve wicks water from the reservoir including minerals and impurities therein into contact with the heating element, wherein energization of the heating element causes the wicked water to convert to steam which rises through the steam exhaust vent and from the housing during a humidification mode, and wherein the minerals and impurities remain within the porous sleeve.

2. The humidifier of claim 1 wherein the steam exhaust vent further comprises a normally open exhaust valve which is closed during a sterilization mode to prevent the steam from rising through the steam exhaust vent, whereby the steam circulates within the humidifier to sterilize surfaces and components therein.

3. The humidifier of claim 2 further comprising a water level sensor in electrical communication with the heating element and the exhaust valve and adapted to sense a water level within the reservoir to enable energization/de-energization of the heating element and opening/closing of the exhaust valve according thereto.

4. The humidifier of claim 3 wherein the tank comprises a normally closed water-release valve that prevents the outflow of water from the tank when the tank is not properly received by the base, and the base comprises a valve actuator adapted to open the water release valve and allow water from the tank into the reservoir there-through until a water level in the reservoir rises to a first water level.

5. The humidifier of claim 4 wherein the water level sensor enables energization of the heating element when the water level in the reservoir rises to the first water level to thereby enable the humidification mode.

6. The humidifier of claim 5 wherein the water level sensor is adapted to sense when the water level in the reservoir falls to a second water level lower than the first water level and to then close the exhaust valve to thereby enable the sterilization mode.

7. The humidifier of claim 6 wherein the water level in the reservoir falls to the second water level when the tank has become empty of water.

8. The humidifier of claim 7 wherein the water level sensor is adapted to sense when the water level in the reservoir falls to a third water level lower than the second water level and to then de-energize the heating element.

9. The humidifier of claim 8 wherein the water level sensor is adapted to enable re-opening of the exhaust valve when the water level in the reservoir falls to the third water level.

10. The humidifier of claim 9 wherein the valve actuator is a float that rises and falls with the water level in the reservoir.

11. The humidifier of claim 10 wherein the housing comprises the water level sensor.

12. The humidifier of claim 11 wherein the top side is a cover removable from the housing and comprising the steam exhaust vent, the fill opening, the exhaust valve, and the one-way fill valve.

13. The humidifier of claim 12 wherein the housing further comprises a cover lock adapted to secure the cover to the housing and prevent its removal during the sterilization mode.

14. The humidifier of claim 8 wherein the reservoir is at or near devoid of water at the third water level.

15. The humidifier of claim 7 further comprising a timer adapted to de-energize the heating element when a predetermined sterilization period has passed.

16. The humidifier of claim 15 wherein the timer is adapted to enable re-opening of the exhaust valve when the predetermined sterilization period has passed.

17. The humidifier of claim 16 wherein the porous sleeve is comprised of a heat-tolerant material and the predetermined sterilization period is long enough to ensure that the porous material has wicked all water from the reservoir during the sterilization period.

18. The humidifier of claim 17 wherein the valve actuator is a float that rises and falls with the water level in the reservoir.

19. The humidifier of claim 18 wherein the housing comprises the water level sensor.

20. The humidifier of claim 19 wherein the top side is a cover removable from the housing and comprising the steam exhaust vent, the fill opening, the exhaust valve, and the one-way fill valve.

21. The humidifier of claim 20 wherein the housing further comprises a cover lock adapted to secure the cover to the housing and prevent its removal during the sterilization mode.

* * * * *